United States Patent [19]

Gray et al.

[11] 4,442,329

[45] Apr. 10, 1984

[54] DEAD TANK HOUSING FOR HIGH VOLTAGE CIRCUIT BREAKER EMPLOYING PUFFER INTERRUPTERS

[75] Inventors: Keith I. Gray, La Verne; Henry G. Meier, Glendale, both of Calif.

[73] Assignee: Brown Boveri Electric Inc., Rolling Meadows, Ill.

[21] Appl. No.: 336,636

[22] Filed: Jan. 4, 1982

[51] Int. Cl.[3] ..... H01H 33/60

[52] U.S. Cl. ..... 200/148 B; 200/148 R; 200/148 A

[58] Field of Search ..... 200/148 R, 148 B, 148 A

[56] References Cited

U.S. PATENT DOCUMENTS 3,009,042 11/1961 Schrameck et al. ..... 200/148 B
3,246,108 4/1966 Colclaser, Jr. et al. ..... 200/148 B
4,109,124 8/1978 Boersma et al. ..... 200/148 B

FOREIGN PATENT DOCUMENTS 626842 7/1949 United Kingdom ..... 200/148 B

*Primary Examiner*—Robert S. Macon
*Attorney, Agent, or Firm*—Ostrolenk, Faber, Gerb & Soffen

[57] ABSTRACT

A cylindrical housing for a high voltage circuit breaker is filled with sulfur hexafluoride and receives three parallel elongated puffer interrupters arranged with their axes on the apices of an equilateral triangle. A single triangular support plate receives one end of each interrupter and supports them in cantilever. The triangular plate is fixed to the housing by thin steel straps affixed to respective apices of the plate. Filter bags in a removable tray are disposed along the horizontal bottom of the housing. Bushings enter the tank through openings in the tank wall. The openings receive slotted flexible tubes which wrap around the slot edges to serve as corona rings. The bushings each have an integral central conductive stud and conductive end plate.

10 Claims, 10 Drawing Figures

DEAD TANK HOUSING FOR HIGH VOLTAGE CIRCUIT BREAKER EMPLOYING PUFFER INTERRUPTERS

BACKGROUND AND SUMMARY OF THE INVENTION

This invention relates to high voltage circuit breakers, and more specifically relates to a novel dead tank housing structure for high voltage circuit breakers which employ at least three puffer-type interrupter assemblies which are disposed parallel to one another and to the axis of the tank and are supported in cantilever from one end of the tank.

Puffer type circuit breakers are well known and are frequently contained within a dead tank type of housing structure.

Circuit breakers of the general type to which the invention is directed are well known. By way of example, a conventional circuit breaker employing puffer type interrupters contained within a dead tank housing for a 145 kV, 40 kA circuit breaker is shown in the product catalog of Brown Boveri Corporation, CH-A-061 312E. Circuit breakers of this kind are also described in the Brown Boveri Review dated April 1978, Volume 65.

The novel dead tank housing structure of the present invention eliminates numerous expensive components and permits simplified assembly and maintenance of circuit interrupters which are contained within the tank. Novel features present in the new dead tank arrangement include:

(a) The bushing structure which is associated with the dead tank contains a novel integral rod and plate configuration which substantially reduces the cost of the bushing and simplifies its maintenance and assembly.

(b) A novel corona discharge prevention ring is formed of a flexible metal tube which is slotted along its length and then forced over and along the periphery of openings in the tank through which the bushing conductor extends. This novel tube serves as an inexpensive corona ring around the sharp corners of the openings which receive the bushings. Since it is a flexible member which is readily commercially available, it can easily follow the shape of any surface on which it is fitted.

(c) A novel filter drier structure, which employs a flat, elongated body, is located in a region of low electric field stress along the bottom of the horizontal cylindrical tank which defines the main body of the dead tank container. The filter mounting permits ease of maintenance and the parts which are required to form the assembly are inexpensive.

DETAILED DESCRIPTION OF THE DRAWINGS

Figure 2:
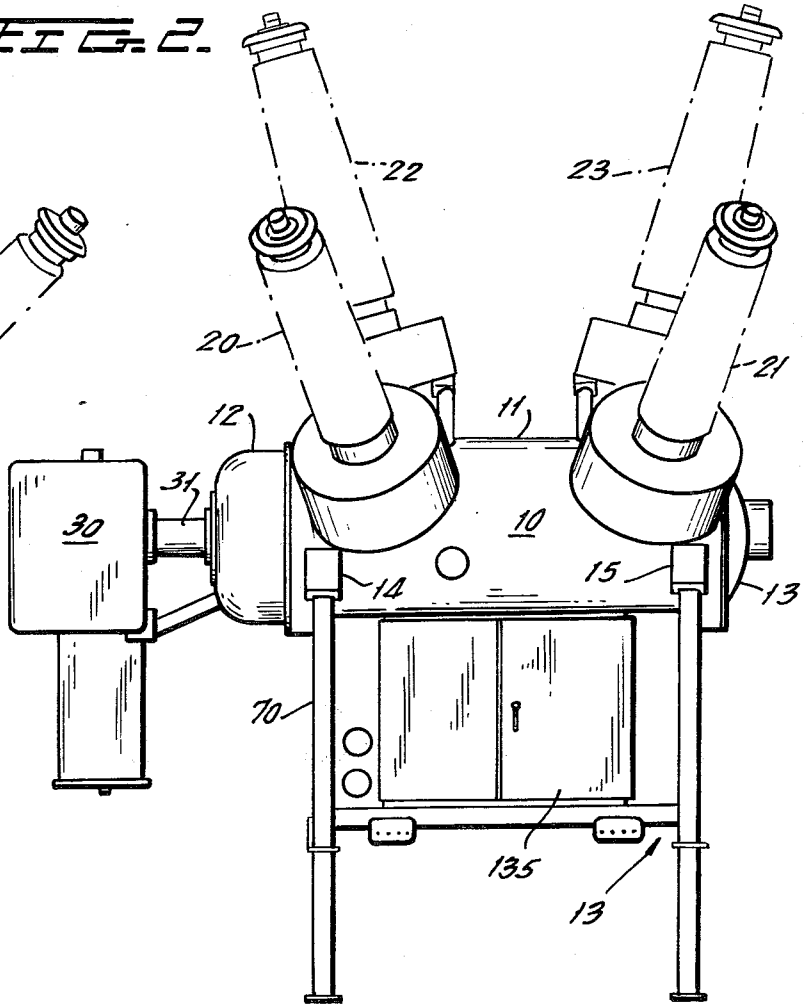
FIG. 2 is a side view of FIG. 1.
Figure 1:
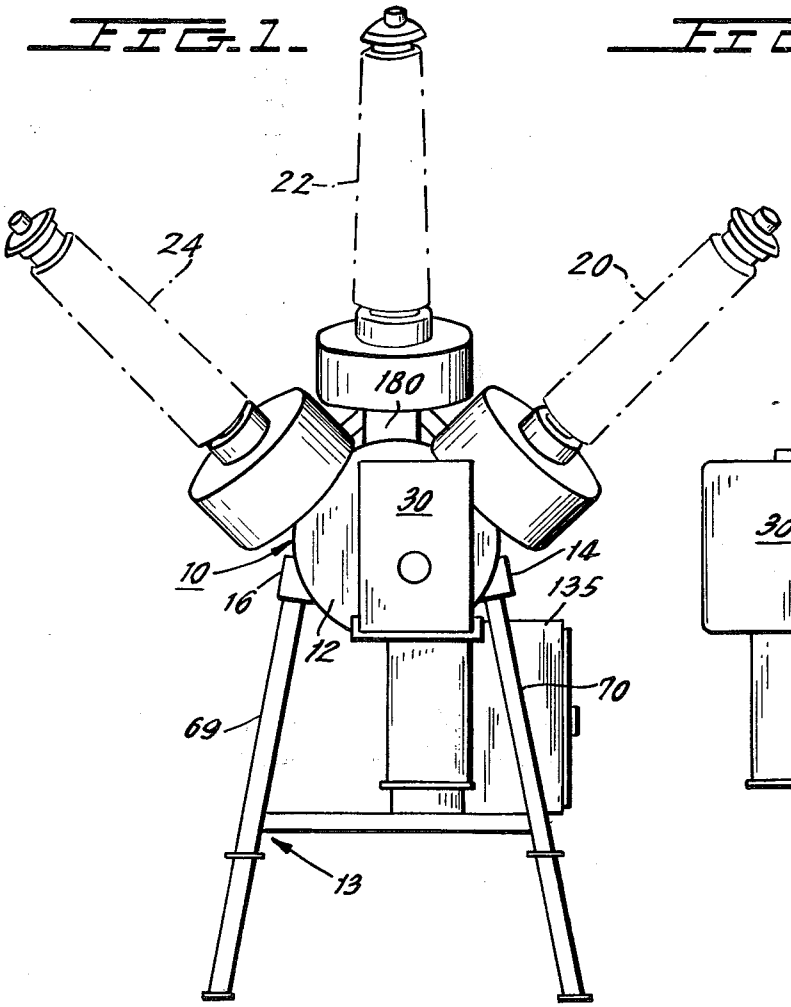
FIG. 1 is a front elevation view of a circuit breaker employing the dead tank construction of the present invention.

Referring first to FIGS. 1 and 2, the circuit breaker assembly is shown therein and consists of a main metal tank 10 having a cylindrical body section 11 and two end bell sections 12 and 13. The tank assembly may be filled with sulfur hexafluoride at relatively low pressure, for example, at about 6–7 atmospheres. The tank assembly 10 is of the dead tank type in that it is at ground potential. The assembly 10 is provided with support legs such as the support framework 13. The support framework 13 is connected to the tank 10 at brackets on the tank body 11, such as the brackets 14 and 15 shown in FIG. 2. A similar pair of brackets is located on the opposite side of the tank. One of these brackets, bracket 16, is shown in FIG. 1.

The circuit breaker of FIGS. 1 and 2 is a three-phase circuit breaker and will contain three puffer type interrupter structures which will be later described, one for each phase. For a 145 kV unit, a single contact break is all that is needed for each interrupter. Each of the three puffer type interrupters is provided with terminals which are connected to respective spaced bushing insulators, shown as bushing insulators 20 and 21 for the first phase, 22 and 23 for the second phase, and a third pair of bushing insulators including the bushing insulator 24 shown in FIG. 1. Each of the bushing insulators is provided with current transformers (not shown). Covers for the current transformers may cover the bases of the bushing insulators at the region where they enter the housing 11. It will be noted that the pairs of bushings for each phase are mounted so that their ends have a greater spacing than their bases to avoid breakdown between the exposed conductive ends of the bushings. Similarly, each of the pairs of insulators of the different phases are angularly displaced from one another as best shown in FIG. 1 to ensure sufficient spacing between the phases of the conductors being connected to the bushings.

The operating mechanism which provides the necessary operating forces for the interrupters contained within the housing 10 is contained within the operating mechanism housing 30. Housing 30 is connected to end member 12 by a neck region 31 which will later be shown to contain contact travel monitoring mechanisms.

Figure 3:
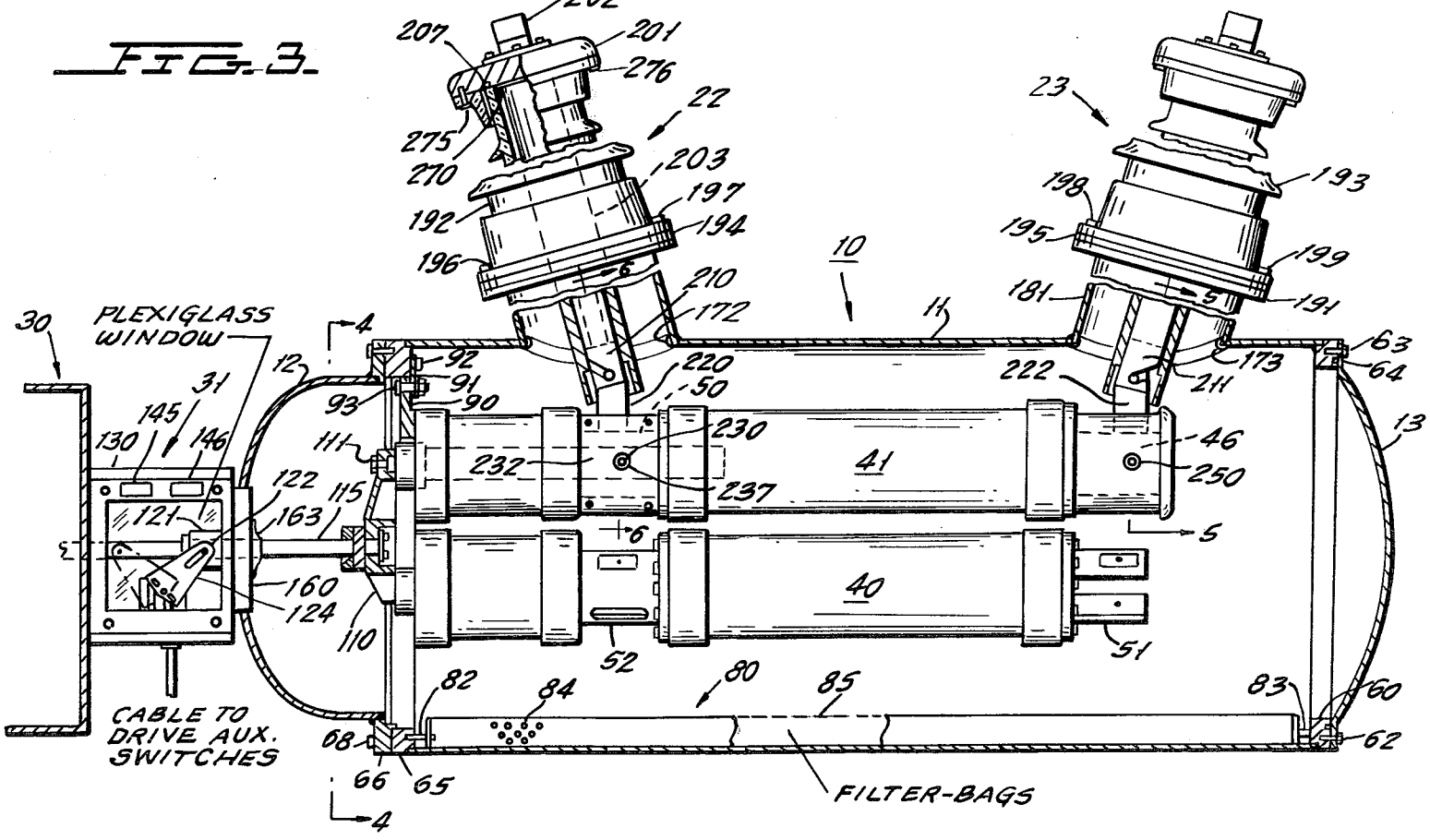
FIG. 3 is a view of the novel dead tank assembly taken along the axis of the tank assembly and through a pair of insulator bushings for the same phase.
Figure 4:
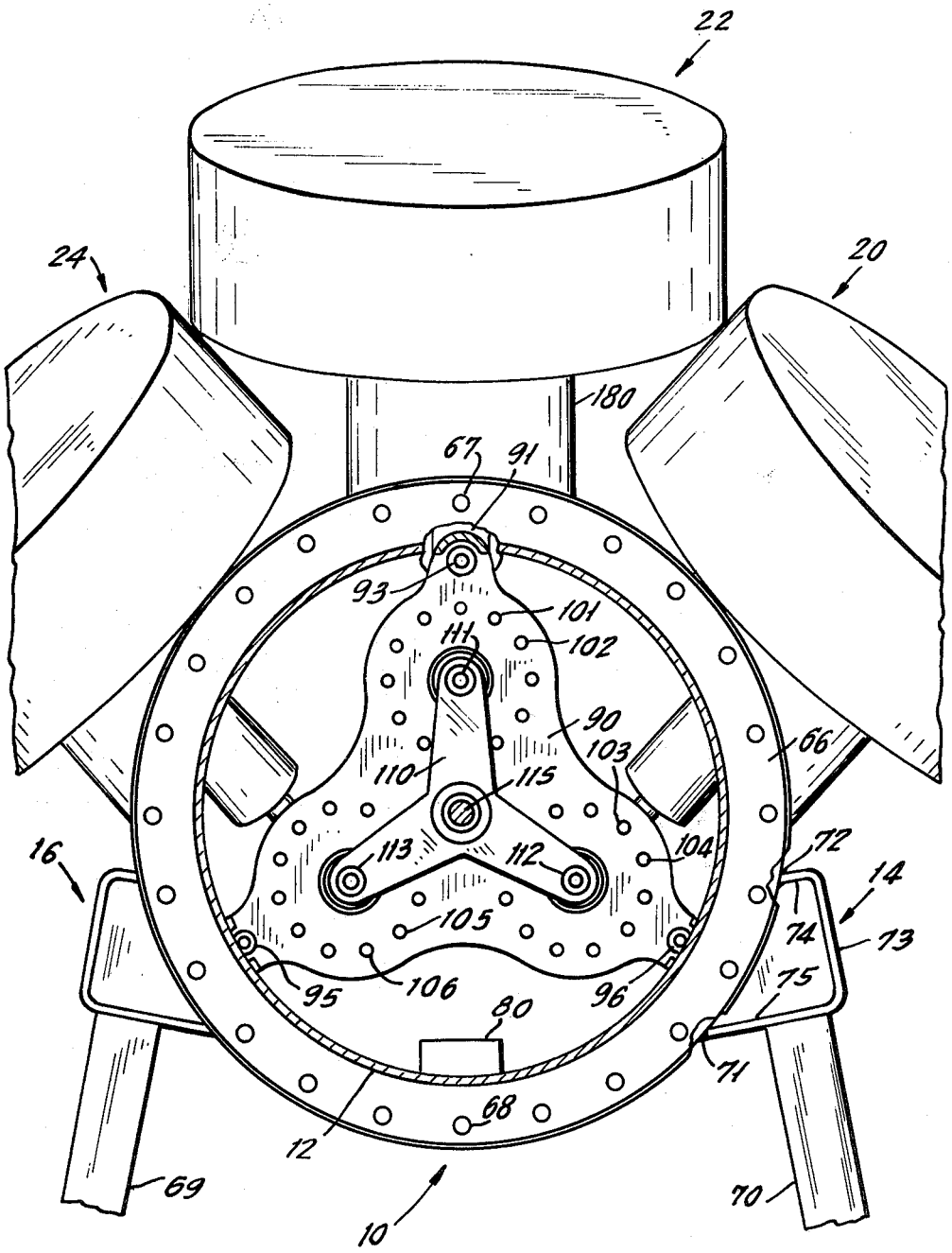
FIG. 4 is a cross-sectional view of FIG. 3 taken across the section line 4—4 in FIG. 3.

Referring next to FIGS. 3 and 4, there is shown therein the detail of the interior structure of the novel dead tank housing and of the interrupters housed therein. FIG. 3 shows two of the three interrupter assemblies which are contained within the housing and which have parallel axes located on the corners of an equilateral triangle. These interrupters include interrupters 40, 41 and another, located behind interrupter 40, which is not shown. Each of interrupters 40, 41 and the third identical interrupter can be of any desired type but may particularly be of the type disclosed in the Brown Boveri Corporation publication referred to above.

Figure 3A:
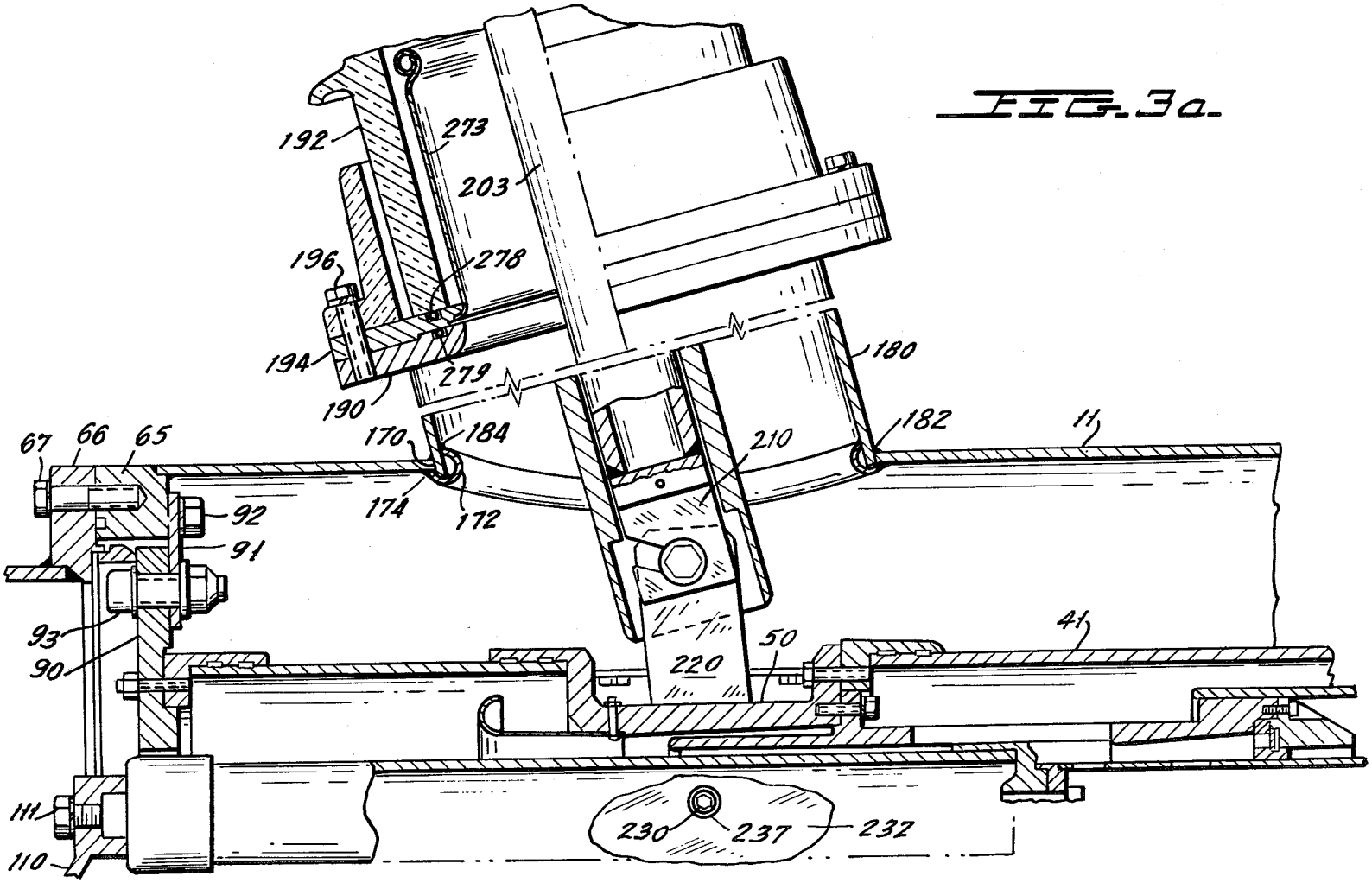
FIGS. 3*a* and 3*b* are enlarged views of portions of FIG. 3.
Figure 3B:
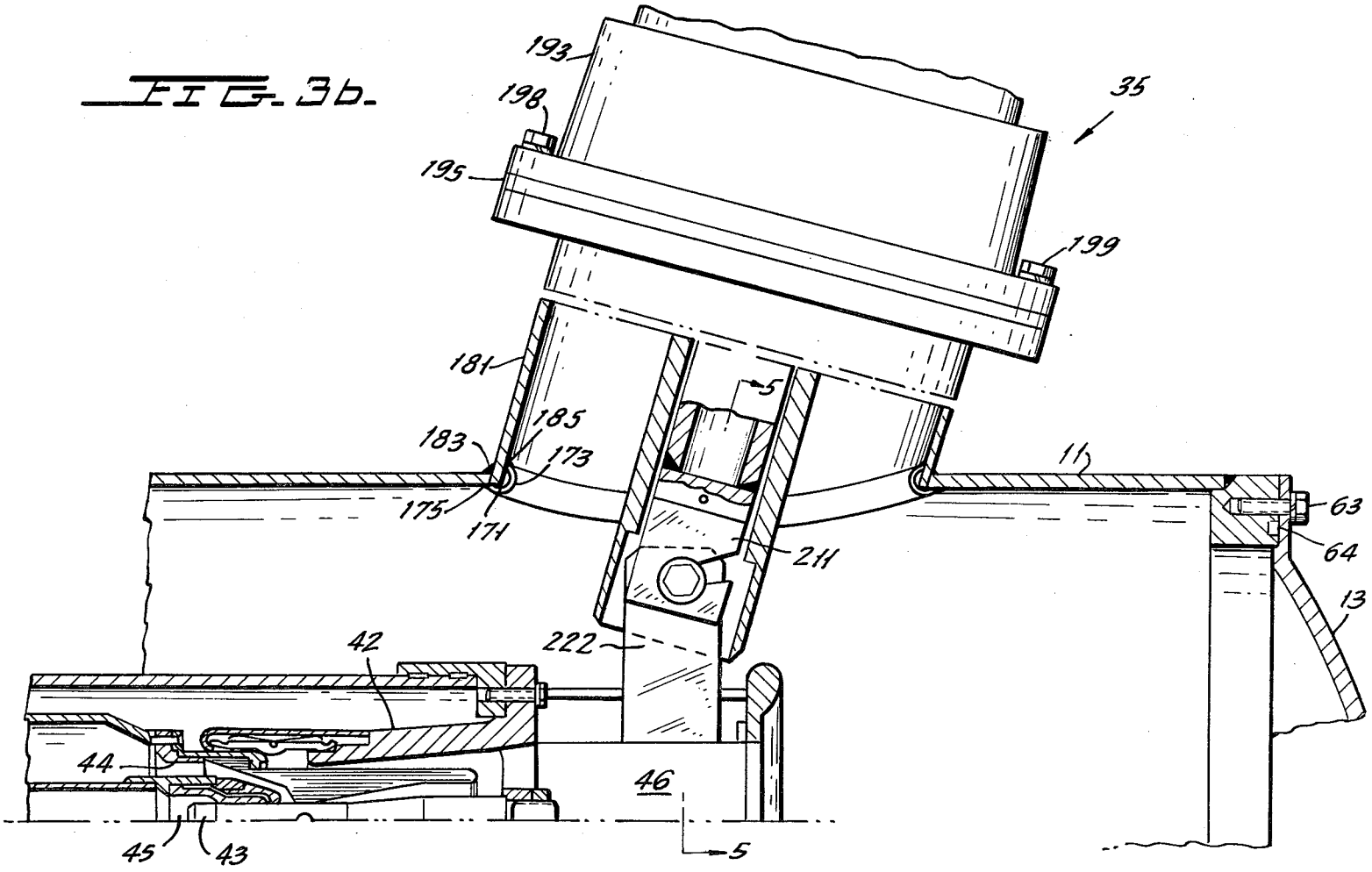

A typical configuration of an interrupter which may be employed is that shown in partial section for interrupter 41 in FIGS. 3*a* and 3*b* where it is seen that the interrupter contains a main stationary contact 42 (FIG. 3*b*) and a parallel arcing contact 43 which cooperate with main movable contact 44 and arcing contact 45, respectively. The main contact 42 is then connected to the terminal 46 which will be later shown to be connected to the bushing terminal 23.

The other end of the interrupter structure 41 is provided with a terminal 50 (FIG. 3*a*) which is ultimately connected to the bushing interrupter 22 as will be later described.

Also shown in FIG. 3 are the terminals 51 and 52 of the interrupter 40, which terminals are ultimately connected to the bushings 21 and 20, respectively, of FIG. 2. The third interrupter which is contained in the arrangement of FIG. 3 and would be disposed directly behind interrupter 40 has similar main terminals which are connected to the bushing insulator pair including bushing insulator 24 in FIG. 1.

Each of the interrupter assemblies is supported from its left-hand end in FIG. 3 and are in cantilever as will be later described.

The dead tank assembly of FIG. 3 is provided with a reinforcing ring 60 welded to its right-hand end and the reinforcing ring 60 has an end cover bell 13 bolted thereto as by a bolt ring including bolts 62 and 63. A pressure-tight connection is made through the use of the circular O-ring 64 which is compressed between the end bell member 13 and the ring 60.

The left-hand end of the cylindrical housing 11 is also provided with a reinforcing ring 65 welded thereto. The end bell 12 is welded to a second reinforcing ring 66 which is bolted to ring 65 by a ring of bolts including bolts 67 and 68. An O-ring seal 68*a* (FIG. 3*a*) is compressed between members 65 and 66. The reinforcing ring 66 and bolts 67 and 68 are also shown in FIG. 4.

Shown particularly in FIG. 4 is the novel configuration of the channel configured leg supports 14 and 16 which are connected to members 69 and 70 of the frame support 13 of FIGS. 1 and 2. Supports 14 and 16 act as nonlinear spring support members. Support members 14 and 16 are constructed of unequally flanged U-shaped steel brackets which are welded to the body 11 as at the welds 71 and 72 in FIG. 4, with the brackets being generally U-shaped and having a web frame section 73 from which extends a short flange 74 and a longer flange 75. The base of the longer flange 75, shown for bracket 14, is then welded to member 71.

This novel configuration is elastically and plastically flexible and helps to more evenly distribute the support stress which is applied to cylindrical member 11 in the support of the circuit breaker. Thus, rotational forces applied to member 14 will be equally distributed and will be less likely to cause distortion of any of the support members. The novel structure of the support framework 13 in combination with members 14 and 15 act like a three-hinged structure which will accommodate lateral displacement of the tank 10 relative to the ground due to shocks caused by ground settlement or earthquakes. By permitting lateral movement, the structure will withstand mechanical force without causing tilting of the bushings or loss of stability of the support.

In FIGS. 3 and 4, the bottom of the tank member 11 is seen to contain elongated filter drier bag assembly 80. The filter drier bags of this assembly contain conventional drier materials for absorbing moisture from the sulfur hexafluoride gas within the tank assembly 10 but are located in a very low electrical stress region at the bottom of the tank. The filter drier bags of assembly 80 are contained within a shallow metal tray 81 which is held in position at the bottom of the tank by the positioning screws 82 and 83 which screw into reinforcing rings 65 and 60, respectively. The tray 81 may have a grill-type configuration, or may have a plurality of openings such as opening 84 therein, as shown in FIG. 3, and may be covered with a lid 85 which holds the filter drier bags within the assembly 80. The assembly 80 may then be easily loaded into the tank or removed therefrom during installation and maintenance.

In order to support the three interrupter structures within the tank, there is provided a novel triangular support plate 90 shown in FIGS. 3, 3*a* and 4. The support plate 90 is supported in a novel relatively flexible manner from the main ring 65 and is connected thereto through three relatively thin steel straps including the thin steel strap 91 shown in FIGS. 3, 3*a* and 4. Similar steel straps are provided at the other two projecting lobes of the plate 90 and act as spring coupling members.

One end of steel strap 91 is bolted to the ring 65 by the bolt 92 (FIG. 3) while the other and lower end of strap 91 is bolted to plate 90 by the bolt 93 shown in FIGS. 3 and 4. Two other bolts 95 and 96, which are similar in function to bolt 93, are shown in FIG. 4. The use of the three relatively thin steel straps for holding the plate 90 in position lends a degree of flexibility to the plate 90 to prevent metal fatigue fracture under frequent high static and dynamic forces which are applied to the plate as during an interruption operation.

By way of example, thin steel straps 91 have a thickness of about $\frac{1}{4}$ inch, a width of about 3 inches and a length of about $4\frac{1}{8}$ inches. By contrast, plate 90 has a thickness of about 1 inch.

The plate 90 is then provided with three circles of bolts which are shown in FIG. 4. The first circle of bolts including bolts 101 and 102 is used to connect the left-hand end of interrupter assembly 41 of FIG. 3 to the plate 90. Thus, the interrupter 41 is supported in cantilever from the plate 90. The second circle of bolts including bolts 103 and 104 is used to support the left-hand end of interrupter 40 shown in FIG. 3 from the plate 90. The third set of bolts including bolts 105 and 106 is used to support the third interrupter in cantilever from plate 90 within the housing of FIG. 3. This interrupter is not seen and is behind interrupter 40.

Each of the interrupter housings is provided with an operating contact rod which is connected to the movable contacts of its interrupter. Each of these contact rods is connected to a respective outer end of the triangular member 110. In FIG. 4, the contact rod of interrupter 41 is disposed immediately behind the connecting bolt 111 which connects member 110 to that operating rod. The operating rod of interrupter 40 and of the third interrupter (not shown in the drawings) are connected immediately behind bolts 112 and 113, respectively, in FIG. 4.

Member 110 is then connected to a main operating rod 115 which is connected to a conventional drive mechanism contained within the housing 30. This mechanism can be of any desired type such as conventional pneumatic operating mechanism.

It will be noted that the structure described to this point permits very simple installation of the interrupters including interrupting housings 40 and 41 in the tank assembly 10 since it is only necessary to open the connection between members 65 and 66 and then insert these interrupters, which have been previously assembled on the common support plate 30. Moreover, the arrangement obviously makes the system capable of easy and rapid maintenance and inspection without prolonged shutdown times.

Figure 7:
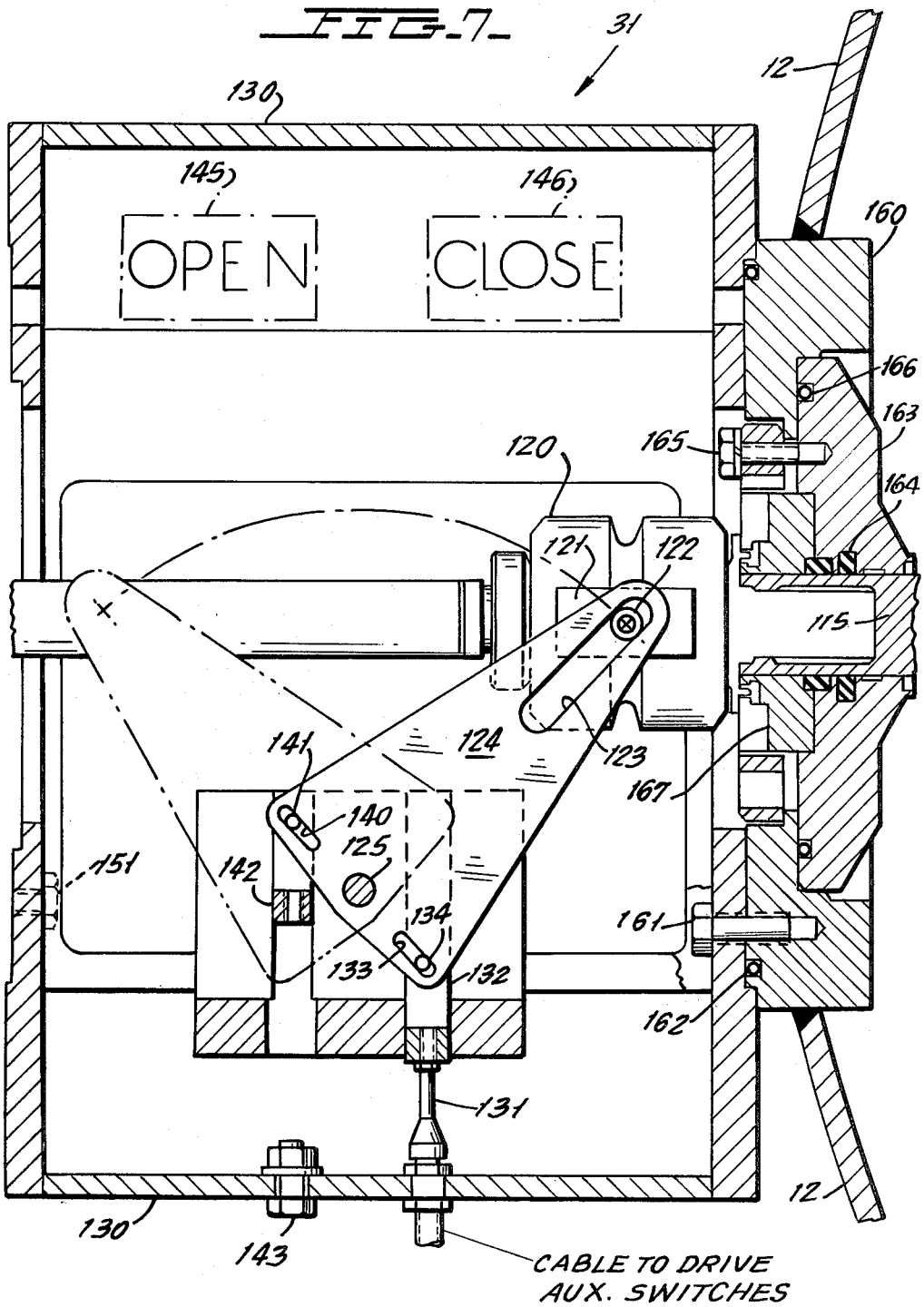
FIG. 7 is an enlarged view of the mechanism monitoring section of the housing as shown in FIG. 3.
Figure 8:
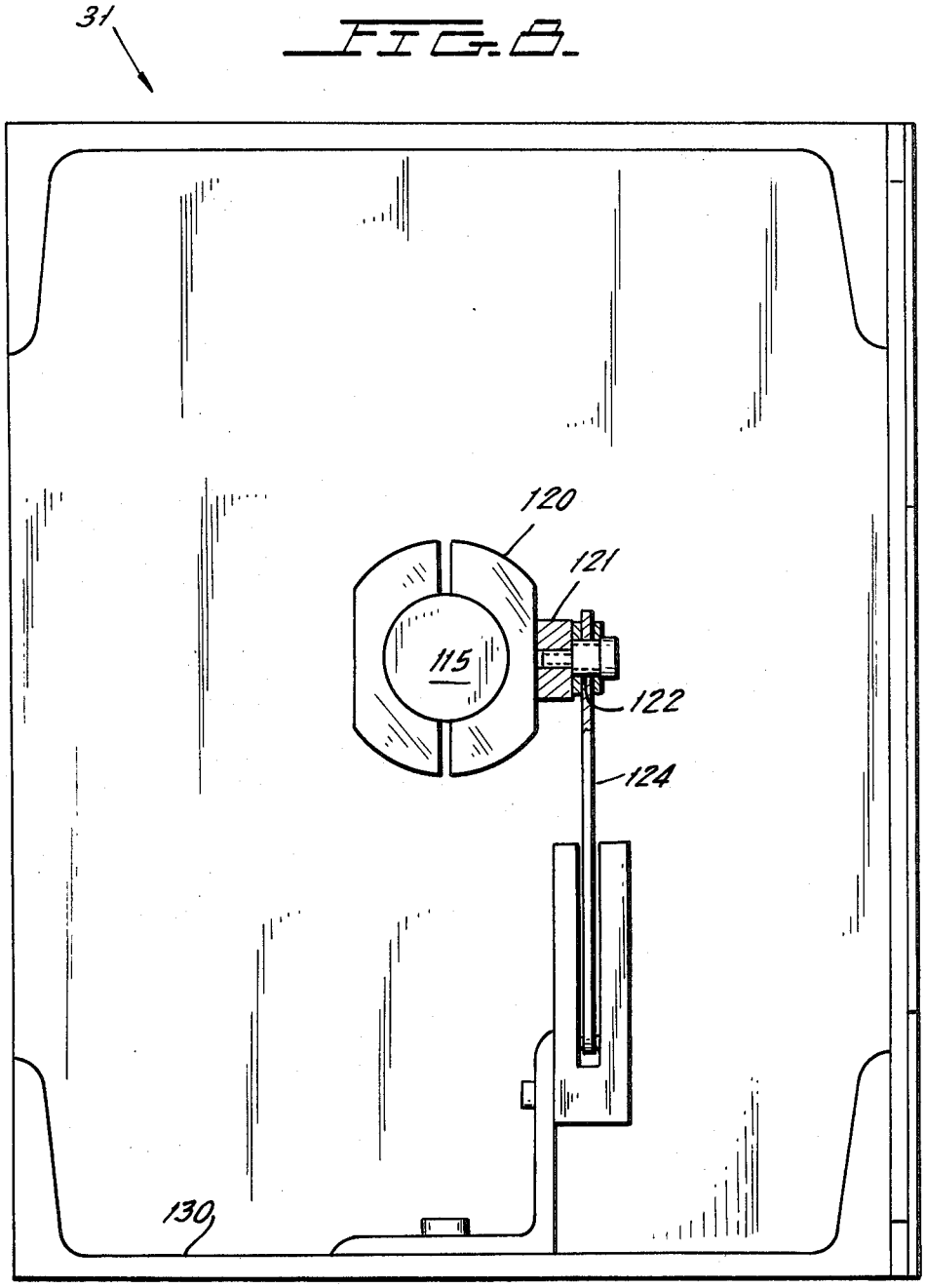
FIG. 8 is an end view of the mechanism of FIG. 7.

It was previously noted that the main operating rod 115 of FIGS. 3 and 4 is driven from a main operating mechanism 30. This operating rod passes through a contact position monitoring assembly 31 which is shown in FIG. 3 and is also shown in FIGS. 7 and 8. Referring to FIGS. 3, 7 and 8, the contact rod 115 has a fitting 120 connected thereto which has an extending ear section 121. Ear section 121 has a cylindrical member 122 extending therefrom which enters slot 123 in crank 124 which is pivotally mounted on a stationary pivot 125. The crank 124 rotates from the solid line position to the phantom line position shown in FIGS. 3 and 7 as the operating rod 115 moves from the engaged position to a disengaged position.

The crank 124 may be contained in a suitable housing 130 which may be sealed from the atmosphere and which has a flexible cable member 131 connected to a movable rod 132 which is, in turn, connected to the slot 133 in crank 124 by a pin 134 extending from member 132. Consequently, this assembly will move the flexible cable 131, shown in FIG. 7, upward or downward depending upon the position of the crank 124, thereby enabling control of auxiliary switches which may be contained in a control cabinet, such as the control cabinet 135 of FIGS. 1 and 2.

Crank 124 also has a further slot 140 therein which is connected to the pin 141 extending from a plunger 142. The plunger 142 may be connected to a suitable flexible cable which can be taken out of the housing 130 through fitting 143 and can be used to record contact travel if this is desired.

The structure of member 131 can be covered by a transparent window which extends over the surface shown in FIG. 3 and exposes the "open" and "close" indicators 145 and 146, respectively. The location of the upper end of crank 124 relative to indicators 145 and 146 can constitute a visual indicator for the circuit breaker condition.

The housing section 31 in FIG. 3 is connected to the operating mechanism 30 through bolts such as bolt 151 (FIG. 7). The other side of housing 31 is connected to the bell-shaped cover 12 in a novel manner which permits the shaft 115 to pass through the end 12 but retains a good seal construction. More specifically, and as shown in FIGS. 3 and 7, a first steel plate 160 is welded to a central opening in the end member 12. The right-hand surface of housing 31 is bolted to plate 160 as by a ring of bolts including the bolt 161 in FIG. 7. An O-ring seal 162 is compressed between the right-hand surface of housing 31 and the plate 160 to ensure a water-tight protection at this joint.

A second plate 163, which contains a sliding seal 164 which extends around the periphery of shaft 115. Plate 163 is bolted to the plate 160 by bolts including the bolt 165 in FIG. 7, with an O-ring 166 being compressed between the two. An intermediate plate 167 and appropriate seals are also employed. This arrangement provides a novel sliding seal structure which enables the shaft 115 to pass through the end bell 12 in a gas-tight manner while still permitting ease of assembly and disassembly of the components.

Turning next to the manner in which the insulation bushings are mounted, it will first be observed that six openings must be formed in the cylinder 11 to permit access of the bushing conductors. Two of these openings are shown in FIGS. 3*a* and 3*b* as openings 170 and 171 respectively. Conventionally, these openings have sharp corners and it is preferred that the sharp corners be protected with corona shields in the form of beads or the like which eliminate or cover sharp corners which could initiate corona discharge.

In accordance with the present invention, a novel flexible steel tube is provided which is of a standard commercial variety of corrugated steel tubes which is flexible and has been used to contain wires or the like.

In accordance with the invention, this flexible tube is cut to length and slotted along its length. The slotted side is forced over the openings 170 and 171 as shown for the two tubes 172 and 173, respectively in FIGS. 3, 3*a* and 3*b*. The tubes are pre-cut to lengths which equal the periphery of the respective openings. In this manner, an extremely inexpensive corona shield is formed around the openings 170 and 171.

The side of the tubes 172 and 173 interiorly of cylindrical member 11 may be tack-welded or otherwise held fixed to the inside of the member 11 as by the welds 174 and 175, respectively.

A conductive cylindrical throat 180 and 181 for bushings 22 and 23, respectively, in FIGS. 3, 3*a* and 3*b* is welded around the openings 170 and 171, respectively, as at the welds 182 and 183, respectively. Note that the tubes 180 and 181 are cut to appropriate shapes and welded to the tank body 11 at the openings 170 and 171. The corona shield tubes 172 and 173 are then welded to the interior of members 180 and 181 as shown by the welds 184 and 185, respectively. The novel corona shields formed by the slotted flexible conductive tubes 172 and 173 can, of course, be applied to any sharp edge which must receive some type of corona bead or ring.

Throat members 180 and 181 are then welded to support plates 190 and 191, respectively, which, in turn, are bolted to the main body of the bushings 22 and 23 in FIGS. 3, 3*a* and 3*b*. These bushings may contain skirted porcelain bodies 192 and 193, respectively and have bottom plates 194 and 195, respectively, which can be bolted to the plate 190 by bolt rings including bolts 196–197 and 198–199, respectively. The upper end of the porcelain 192 and 193 then receives conventional upper conductive plate 201 and a similar plate not shown for insulator 23. Suitable terminals, such as terminal 202 for insulator 22, are connected to the plate 201.

Figure 6:
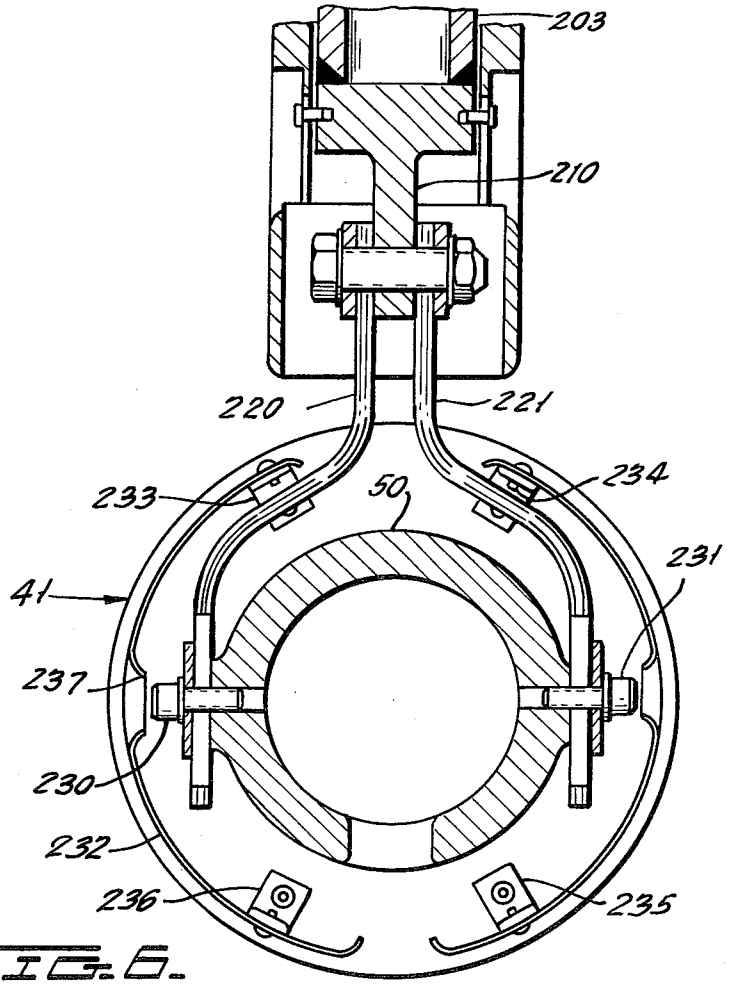
FIG. 6 is a cross-sectional view of FIG. 3 taken across the section line 6—6 in FIG. 3.
Figure 5:
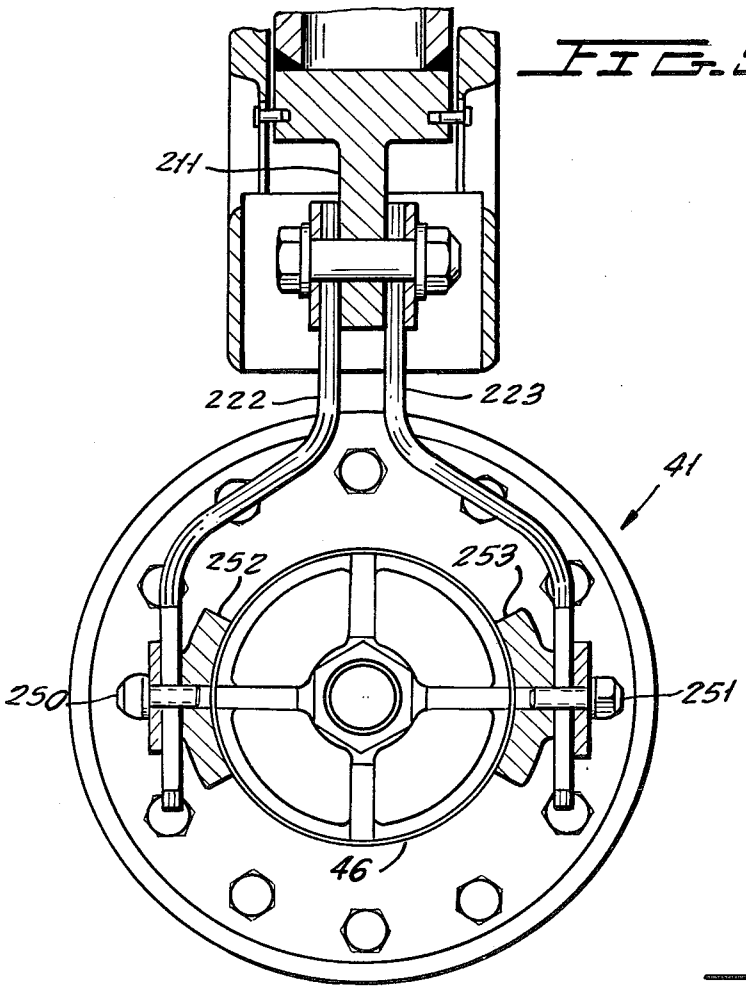
FIG. 5 is a cross-sectional view of FIG. 3 taken across the section line 5—5 in FIG. 3.

A main conductive stud 203 then extends along the length and interiorly of the porcelain shell of each of the insulator bushings and is ultimately connected to a bottom connection tongue 210 for bushing 22 and bottom connection tongue 211 for bushing 23 in FIGS. 3*a* and 3*b*. Tongue member 210 and tongue member 211 are also shown in FIGS. 6 and 5, respectively.

A novel and simple flexible connection arrangement is then provided to connect the end of the bushing insulator central studs to their respective interrupter terminals. Thus, as shown in FIGS. 3, 5 and 6, the tongue members 210 and 211 are connected to pairs of flexible conductors 220–221 and 222–223, respectively. Flexible conductors 220–221 are then bolted to the opposite sides of the interrupter terminal 50 of interrupter 41 by the bolts 230 and 231, respectively. An appropriate corona shield 232 (FIGS. 3, 3*a* and 6) supported by the four brackets 233 to 236 surround the connection. Note that an opening 237 is provided in the shield 232 to enable access to the bolt 230 and a similar opening is provided in alignment with the bolt 231. This novel arrangement forms a flexible connection between the end of the stud 203 and terminal 50 of interrupter assembly 41 which is relatively easily made and provides ease of maintenance and assembly for the structure.

A similar connection is provided for the terminal 46 of interrupter assembly 41 in order to make connection to the connector member 211. Thus, as shown in FIGS. 3, 3*b* and 5, the flexible conductors 222 and 223 are bolted to the terminal 46 by bolts 250 and 251 on opposite sides of terminal 46 through respective conductive pressure pads 252 and 253, respectively. Note that this connection can be made simply by removing the end bell 13 which provides direct access to the terminal 46. Corona shielding can be provided if desired.

As a further feature of the invention, and as is also shown in FIG. 3, the bushing structure is made relatively inexpensive by making the plate 201 and the stud 203 integral members, wherein stud 203 is welded to plate 201 at the weld 270. The insulator housing is then held assembled by a bolt ring arrangement including bolts 275 and 276 which clamp the upper end of the porcelain assembly against the plate 201 and the O-ring seal 277. The bottom end of the insulator 22 is sealed so that there will be no leakage of the sulfur hexafluoride gas within the tank assembly or bushing. Thus, members 194 and 190 are bolted by the bolts including bolts 196 and 197 which compress seals 278 and 279 which are conventional O-ring seals.

Although several preferred embodiments of this invention have been described, many variations and modifications will now be apparent to those skilled in the art, and it is therefore preferred that the instant invention be limited not by the specific disclosure herein, but only by the appending claims.

What is claimed is:

1. A dead tank high voltage circuit breaker comprising, in combination: a gas-filled cylindrical elongated metal housing having an exterior support framework; first, second and third elongated interrupter structures disposed parallel to one another and having respective central axes which are equally spaced from one another; three pairs of insulator bushings, each of said three pairs connected to the opposite ends of respective ones of said first, second and third interrupter structures; each of said pairs of bushings extending outwardly of said metal housing to provide exterior connection points for each of said interrupter structures; an operating mechanism disposed exteriorly of said elongated metal housing and having operating shaft means connected to each of said interrupter structures for simultaneously operating each of said interrupter structures; a generally triangularly shaped flat support plate for supporting said first, second and third interrupter structures in cantilever within said housing; one end of each of said interrupter structures being fixed to said support plate with the axes of said interrupter structures perpendicular to the plane of said plate; and first, second and third relatively thin straps having one of their ends fixed to respective apices of said triangularly shaped plate and their opposite ends fixed to said metal housing; said first, second and third straps being more flexible than said plate.

2. The device of claim 1, wherein said plate and said straps are of steel; said straps being thinner than said plate.

3. A dead tank high voltage circuit breaker comprising, in combination: a gas-filled cylindrical elongated metal housing having an exterior support framework; first, second and third elongated interrupter structures disposed parallel to one another and having respective central axes which are equally spaced from one another; three pairs of insulator bushings; each of said three pairs connected to the opposite ends of respective ones of said first, second and third interrupter structures; each of said pairs of bushings extending outwardly of said metal housing to provide exterior connection points for each of said interrupter structures; an operating mechanism disposed exteriorly of said elongated metal housing and having operating shaft means connected to each of said interrupter structures for simultaneously operating each of said interrupter structures; said gas-filled metal housing being filled with sulfur hexafluoride under positive pressure; and an elongated tray filled with filter drier material for absorbing moisture from said gas disposed on the bottom of said cylindrical metal housing and being disposed generally parallel to said axes of said interrupter structures; the axes of said first and second interrupter structures lying in a horizontal plane which is below said axis of said third interrupter structure whereby said tray has the greatest possible lateral spacing from any one of said interrupter structures.

4. The device of claim 3 which further includes a generally triangularly shaped flat support plate for supporting said first, second and third interrupter structures in cantilever within said housing; one end of each of said interrupter structures being fixed to said support plate with the axes of said interrupter structures perpendicular to the plane of said plate.

5. The device of claim 1 or 2 wherein said gas filled metal housing is filled with sulfur hexafluoride under positive pressure; and an elongated tray filled with filter drier material for absorbing moisture from said gas disposed on the bottom of said cylindrical metal housing and being disposed generally parallel to said axes of said interrupter structures; the axes of said first and second interrupter structures lying in a horizontal plane which is below said axis of said third interrupter structure whereby said tray has the greatest possible lateral spacing from any one of said interrupter structures.

6. A dead tank high voltage circuit breaker comprising, in combination: a gas-filled cylindrical elongated metal housing having an exterior support framework; first, second and third elongated interrupter structures disposed parallel to one another and having respective central axes which are equally spaced from one another; three pairs of insulator bushings, each of said three pairs connected to the opposite ends of respective ones of said first, second and third interrupter structures; each of said pairs of bushings extending outwardly of said metal housing to provide exterior connection points for each of said interrupter structures; an operating mechanism disposed exteriorly of said elongated metal housing and having operating shaft means connected to each of said interrupter structures for simultaneously operating each of said interrupter structures; said cylindrical metal housing having a plurality of generally circular openings therein; each of said openings having relatively sharp peripheral edges which would create high dielectric stress in the gas adjacent said edge in the presence of a high electric field; each of said insulator bushings being fixed to said metal housing at a respective one of said openings and having a bushing conductor which extends through said respective opening; and respective corona shield means for the edges of said openings; each of said corona shield means comprising a hollow flexible metal corrugated tube; each of said tubes having a length equal to the periphery of their respective opening, and being bent to the shape of their respective opening; each of said tubes having a slot in their outer periphery; said peripheral edge of each of said openings being received in the said slot of their respective flexible tubular corona shields.

7. The device of claim 6 wherein said corona shields are welded to the periphery of their said respective openings.

8. The device of claim 1 or 3 wherein said cylindrical metal housing has a plurality of generally circular openings therein; each of said openings having relatively sharp peripheral edges which would create high dielectric stress in the gas adjacent said edge in the presence of a high electric field; each of said insulator bushings being fixed to said metal housing at a respective one of said openings and having a bushing conductor which extends through said respective opening; and respective corona shield means for the edges of said openings; each of said corona shield means comprising a hollow flexible metal corrugated tube; each of said tubes having a length equal to the periphery of their respective opening, and being bent to the shape of their respective opening; each of said tubes having a slot in their outer periphery; said peripheral edge of each of said openings being received in the said slot of their respective flexible tubular corona shields.

9. A dead tank high voltage circuit breaker comprising, in combination: a gas-filled cylindrical elongated metal housing having an exterior support framework; first, second and third elongated interrupter structures disposed parallel to one another and having respective central axes which are equally spaced from one another; three pairs of insulator bushings, each of said three pairs connected to the opposite ends of respective ones of said first, second and third interrupter structures; each of said pairs of bushings extending outwardly of said metal housing to provide exterior connection points for each of said interrupter structures; an operating mechanism disposed exteriorly of said elongated metal housing and having operating shaft means connected to each of said interrupter structures for simultaneously operating each of said interrupter structures; each of said insulator bushings comprising a hollow gas-filled insulation shell, a central conductive stud coaxial with said shell and extending the length of said bushing and connected to an end of a respective one of said interrupter structures, and a conductive end plate at the free end of said bushing; said conductive end plates being compressed against the free ends of their said respective insulation shells; said conductive end plates being welded to an end of their said respective central conductive stud to produce an integral conductive stud and end plate structures for each of said bushings.

10. The device of claim 1, 3 or 6, wherein each of said insulator bushings comprises a hollow gas-filled insulation shell having a central conductive stud coaxial with said shell and extending the length of said bushing and connected to a respective one of said interrupters and a conductive end plate at the free end of said bushing; said conductive end plates being compressed against the free ends of their said respective insulation shells; said conductive end plates being welded to an end of their said respective central conductive stud to produce an integral conductive stud and end plate structures for each of said bushings.

* * * * *